United States Patent [19]

Brown

[11] Patent Number: 4,725,208

[45] Date of Patent: Feb. 16, 1988

[54] POSITIVE SHUT OFF ELECTROMAGNETIC FLUID PUMP

[75] Inventor: Ralph V. Brown, Cayuta, N.Y.

[73] Assignee: Facet Enterprises, Inc., Tulsa, Okla.

[21] Appl. No.: 837,840

[22] Filed: Mar. 10, 1986

[51] Int. Cl.[4] ..... F04B 17/04

[52] U.S. Cl. ..... 417/417; 310/30

[58] Field of Search ..... 417/415, 417, 418; 92/85 R; 310/30

[56] References Cited

U.S. PATENT DOCUMENTS

| | | | |
|---|---|---|---|
| 1,162,562 | 11/1915 | Brown | 92/85 R |
| 2,984,529 | 5/1961 | Dailey | 92/85 R |
| 3,039,127 | 6/1962 | Molenaar | 92/85 R |
| 4,101,950 | 7/1978 | Hager et al. | 417/417 |
| 4,488,477 | 12/1984 | Miyamoto | 92/85 R |
| 4,643,653 | 2/1987 | Masaka et al. | 417/417 |
| 4,661,048 | 4/1987 | Masaka et al. | 417/417 |

*Primary Examiner*—Carlton R. Croyle
*Assistant Examiner*—Timothy S. Thorpe
*Attorney, Agent, or Firm*—James R. Ignatowski; Remy J. VanOphem

[57] ABSTRACT

A positive shut-off electromagnetic fluid pump of the type having a piston electromagnetically reciprocated in a cylindrical guide by a solenoid coil and a pair of valves for providing a unidirectional fluid flow from an inlet port to an outlet port in response to the reciprocation of the piston. An elastomer bumper attached to the piston occludes the outlet port when the piston is biased to its extreme position adjacent to the outlet port when the solenoid coil is de-energized.

15 Claims, 3 Drawing Figures

POSITIVE SHUT OFF ELECTROMAGNETIC FLUID PUMP

FIELD OF THE INVENTION

The invention is related to electromagnetic fluid pumps and, in particular, to a positive shut off mechanism to eliminate fluid siphoning and/or draining when the power to the pump is turned off.

BACKGROUND OF THE INVENTION

Electromagnetic fluid pumps of the type taught by Wertheimer in U.S. Pat. No. 3,400,663 or by Brown in U.S. Pat. No. 4,079,436 have found wide acceptance for a variety of uses in both the industrial and commercial markets. One of the problems encountered in the use of these pumps is that they have a tendency to drain and loose their prime when they are located above the fluid reservoir or to siphon fluid from the fluid reservoir when they are located below the level of the fluid reservoir. This problem has been addressed by the prior art in a variety of ways. Barthalon in U.S. Pat. No. 4,021,151 discloses a reciprocating piston air pump in which the outlet ports are disposed in the side walls of the compression chamber. In the unactuated state of the pump the piston is biased to a full upward position in which the side walls of the piston block the outlet passages. Toyoda in U.S. Pat. No. 4,252,505 discloses a reciprocating piston fluid pump having a separate spring biased valve member to block the pump's outlet port when the pump is de-energized. The separate valve member is displaced to the open position by a separate solenoid coil. Nakamura in U.S. Pat. No. 3,877,841 and Nomura in U.S. Pat. No. 4,255,094, like Toyoda, disclose a separately movable valve member to block or shut off the pump's outlet port when the pump is de-energized. This movable valve is open only when the solenoid coil is energized. The present invention is a solution to the siphoning and draining problems which eliminates the need for a separate movable valve to close the outlet port when the solenoid coil is de- energized.

SUMMARY OF THE INVENTION

The present invention is a positive shut-off electromagnetic fluid pump having a housing defining a cylindrical guide, an inlet port disposed at one end of the cylindrical guide and an outlet port disposed at the other end. The pump further has a spring which biases the piston towards the outlet port, a solenoid coil for displacing the piston towards the inlet port, an electronic circuit for periodically energizing the solenoid to reciprocate the piston in the cylindrical guide, a pair of valves for providing unidirectional fluid flow from the inlet port to the outlet port in response to the reciprocation of the piston, and an elastic bumper attached to the end of the piston adjacent to the outlet port for occluding the outlet port when the piston is biased by the spring to its extreme position adjacent to the outlet port.

The principal object of the present invention is to provide a positive shut-off of the fluid flow through the pump when the pump is de-energized. Another object of the invention is to prohibit siphoning through the pump when the utilization device is disposed at a lower level than the fluid in the reservoir. A final object of the invention is to provide a positive shut-off of the fluid flow through the pump without the need for an independent movable valve member and/or external solenoid valves.

These and other objects of the present invention will become more apparent from a reading of the specification in conjunction with the appended figures.

DETAILED DESCRIPTION OF THE PREFERRED EMBODIMENT

Figure 1:
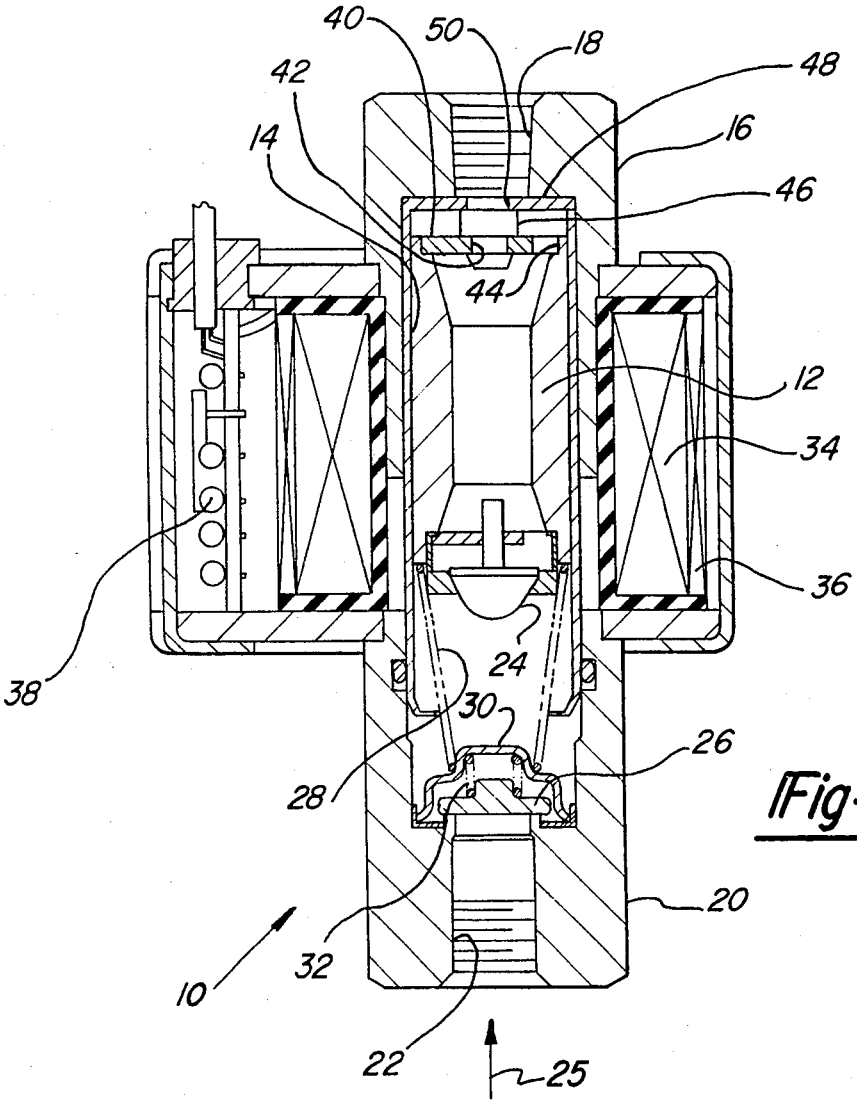
FIG. 1 is a cross-sectional side view of the positive shut-off electromagnetic fluid pump.

Referring to FIG. 1, there is shown an electromagnetic fluid pump 10 having positive shut-off capabilities. The pump 10 has a cylindrically shaped piston 12 slidably disposed in a non-magnetic cylindrical guide member 14. One end of the cylindrical guide member 14 is attached to an outlet housing member 16 having a fluid outlet port 18 provided therethrough concentric with the guide member 14. The other end of the guide member 14 is attached to an inlet housing member 20 having a fluid inlet port 22 provided therethrough concentric with the guide member 14.

A first valve member 24 is attached to the piston 12 at the end adjacent to the fluid inlet port 22 and a second valve member 26 is attached to the inlet housing member 20 and controls the fluid flow through the fluid inlet port 22. The first and second valve members 24 and 26, respectively, operate in a known manner to provide a unidirectional fluid flow through the pump 10 from the inlet port 22 to the outlet port 18, as indicated by arrow 25.

A piston spring 28 disposed in the guide member 14 between the piston 12 and a spring seat member 30 produces a force biasing the piston 12 towards the outlet port 18 and the spring seat member 30 towards the inlet port 22. A valve spring 32 disposed between the spring seat member 30 and the second valve member 26 biases the second valve member to close or occlude the inlet port 22.

A solenoid coil 34 circumscribes the guide member 14 and produces a magnetic force operative to displace the piston 12 towards the inlet port 22 against the force of the piston spring 28. The solenoid coil 34 is energized by an electronic circuit 38. The electronic circuit 38 may be a blocking oscillator of the type taught by R. V. Brown in U.S. Pat. No. 4,464,613 responsive to the signal induced in a detector coil 36 or may be any other type of electronic oscillator or timer circuit operative to periodically energize the solenoid coil 34 causing the piston 12 to reciprocate within the guide member 14.

Figure 2:
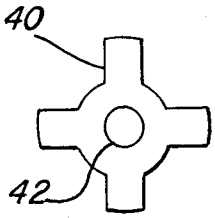
FIG. 2 is a top view of the non-magnetic bumper bracket.
Figure 3:
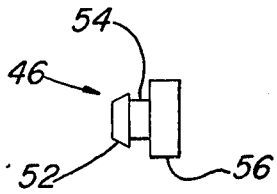
FIG. 3 is a side view of the elastic bumper.

Attached to the end of the piston 12 adjacent to the outlet port 18 is a support plate 40 having a centrally disposed aperture 42. The support plate 40 has a spider like configuration, as shown in FIG. 2, to permit a fluid flow therepast. Preferably the support plate is made from a plastic or non-magnetic material but may be made from a magnetic material. The support plate 40 may be pressed into a recess 44 provided at the end of the piston 12 or attached to the end of the piston 12 using any other method known in the art. An elastic bumper 46, having the configuration shown in FIG. 3, is pressed into the aperture 42 provided in the support plate 40. A button 52 provided at the end of a button stem 54 locks the elastic bumper 46 in the support plate's aperture. The elastic bumper 46 has an enlarged head 56 which occludes an aperture 50 provided in an outlet aperture plate 48. Alternatively, the elastic bumper 46 may consist of only the enlarged head 56 which is bonded to the surface of the support plate 40.

The aperture plate 48 is captivated between the end of the guide member 14 and the outlet housing member 16 with the aperture 50 concentric with the elastic bumper 46. In an alternate embodiment, not shown, the aperture plate may be eliminated and the diameter of the outlet port 18 reduced to a size smaller than the diameter of the elastic bumper's enlarged head 56.

The elastic bumper 46 is preferably made from an elastomer, such as BUNA-N or VITRON, compounded for low swelling in unleaded gasoline.

The inlet and outlet ports 22 and 18, respectively, may be threaded, as shown in FIG. 1, to facilitate the attachment of connecting fluid pipes, hoses, etc. as is known in the art.

In the static or de-energized state of the positive shut-off fluid pump the piston spring 28 biases the piston 12 towards the outlet port 18. In the extreme displaced position of the piston 12 the elastic bumper 46 seals or occludes the aperture 50 of the aperture plate 48 which prevents a fluid flow in either direction through the outlet port 18. Therefore, in the static or unenergized state, fluid can neither be siphoned from nor be drained back into the fluid reservoir, through the pump 10. Further, there is no hydraulic lockup of the pump because the bumper 46 will only seal the aperture 50 when the piston is fully displaced by the piston spring 28 towards the outlet port 18. From this position, the piston 12 can only be displaced away from the outlet port 18 by the solenoid coil 34. The displacement of the piston 12 away from the outlet port does not change the internal volume of the pump defined by the guide member 14 and the outlet and inlet housing members 16 and 20, respectively. As the piston 12 is displaced towards the inlet port 22 by the solenoid coil 34, the first valve member 24 will open permitting the piston to move freely. Once the piston is displaced the outlet port is opened. Thereafter the piston 12 is free to reciprocate in response to the electronic circuit cyclically energizing the solenoid coil 34. Reciprocation of the piston 12 will provide a unidirectional fluid flow through the pump from the inlet to the outlet ports. As previously described, the direction of the fluid flow is determined by the first and second valve members 24 and 26, respectively. When the pump is de-energized the piston spring 28 will again displace the piston 12 to its extreme position adjacent to the outlet port 18 with the elastic bumper 46 sealing the exit aperture 50.

It is not intended that the invention be limited to the specific embodiment illustrated in the drawings and discussed in the specification. It is recognized that a person skilled in the art will be able to adopt the invention to other pump configurations or make changes within the spirit of the invention as described above and set forth in the appended claims.

What is claimed is:

1. A positive shut-off electromagnetic fluid pump comprising:

a housing having a cylindrical passageway, an inlet port disposed at one end of said cylindrical passageway, and an outlet port disposed at the other end of said cylindrical passageway;

a hollow cylindrical piston slidably disposed in said cylindrical passageway;

resilient means for biasing said piston towards said outlet port;

a solenoid coil for generating a magnetic force to displace said piston towards said inlet port against the force of said resilient means;

electronic circuit means for periodically energizing said solenoid coil to cause said piston to reciprocate in said cylindrical passageway;

valve means for providing a unidirectional fluid flow through said cylindrical passageway from said inlet port to said outlet port in response to the reciprocation of said piston; and elastic bumper means attached to the end of said piston adjacent to said outlet port for inhibiting a fluid flow through said outlet port when said piston is displaced to its extreme position adjacent to said outlet port by said resilient means.

2. The fluid pump of claim 1 wherein said outlet port is concentric with said cylindrical passageway and said elastic bumper means is concentric with said outlet port.

3. The fluid pump of claim 2 having an aperture plate disposed at the end of said cylindrical passageway adjacent to said outlet port, said aperture plate having a centrally disposed aperture connecting said cylindrical passageway with said outlet port and wherein said aperture is occluded by said elastic bumper means.

4. The fluid pump of claim 3 wherein said elastic bumper means comprises a support plate attached to the end of said piston and an elastomer bumper attached to said support plate concentric with said aperture.

5. The fluid pump of claim 4 wherein said elastomer bumper is made from an elastomer compounded for minimum swelling in non-leaded gasoline.

6. The fluid pump of claim 1 wherein said electronic circuit means is a blocking oscillator.

7. A positive shut-off electromagnetic pump having a housing defining an internal cylindrical passageway, an inlet port provided at one end of said internal cylindrical passageway, an outlet port provided at the other end of said internal cylindrical passageway, a piston disposed in said internal cylindrical passageway between said inlet and outlet ports, resilient means for biasing said piston towards said outlet port, a solenoid coil for generating a magnetic force to displace said piston towards said inlet port against the bias of said resilient means, electronic means periodically energizing said solenoid coil to reciprocate said piston in said internal cylindrical passageway, and valve means for providing a unidirectional fluid flow through said pump in response to the reciprocation of said piston, said positive shut-off fluid pump characterized by an elastic bumper attached to the end of said piston for occluding said outlet port to prevent a fluid flow therethrough in either direction when said piston is displaced by said resilient means to its extreme position adjacent to said outlet port when the solenoid coil is de-energized.

8. The pump of claim 7 wherein said housing includes an aperture plate disposed at the end of said internal cylindrical passageway adjacent to said outlet port, said aperture plate having an axially disposed aperture providing a fluid connection between said internal cylindrical passageway and said outlet port, and wherein said aperture is occluded by said elastic bumper to prohibit a fluid flow through said outlet port when said piston is displaced to its extreme position by said resilient means.

9. The pump of claim 7 wherein said elastic bumper comprises:

a support plate attached to the end of said piston adjacent to said outlet port; and an elastomer bumper attached to said support plate concentric with said outlet port.

10. The pump of claim 9 wherein said support plate has an axial aperture provided therethrough, and said elastomer bumper has an enlarged head disposed on the surface of said support plate adjacent to said outlet port, a stem received through said axial aperture and a button provided at the end of said stem engaging the other surface of said support plate to secure said elastomer bumper to said support plate.

11. The pump of claim 9 wherein said elastomer bumper is made from an elastomer compounded to have minimum swelling in unleaded gasoline.

12. A positive shut-off reciprocating piston fluid pump comprising:

a cylindrical guide;

an inlet port disposed at one end of said cylindrical guide;

an outlet port disposed at the other end of said cylindrical guide;

a hollow cylindrical piston disposed for reciprocation in said cylindrical guide;

a spring biasing said piston towards said outlet port;

electromagnetic means cooperating with said spring for reciprocating said piston in said cylindrical guide;

valve means responsive to the reciprocation of said piston for providing a unidirectional fluid flow through said cylindrical guide; and an elastomer bumper attached to the end of said piston for occluding said outlet port when said electromagnetic means is de-energized and said piston is displaced to its extreme position adjacent to said outlet port by said spring.

13. The fluid pump of claim 12 wherein said outlet port and said elastomer bumper are disposed concentric with the axis of said cylindrical guide.

14. The fluid pump of claim 13 wherein said outlet port includes an aperture plate having an exit aperture occluded by said elastomer bumper when said piston is displaced to its extreme position adjacent to said outlet port by said spring.

15. The fluid pump of claim 12 wherein said electromagnetic means comprises:

a solenoid coil circumscribing said cylindrical guide; and an electronic circuit for periodically energizing said solenoid coil.

* * * * *